US006638117B2

(12) United States Patent
Murakami et al.

(10) Patent No.: US 6,638,117 B2
(45) Date of Patent: Oct. 28, 2003

(54) CONNECTOR TERMINAL HAVING TAB WITH TAPERED PORTION

(75) Inventors: Takao Murakami, Shizuoka (JP); Chieko Torii, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/196,156

(22) Filed: Jul. 17, 2002

(65) Prior Publication Data

US 2003/0017755 A1 Jan. 23, 2003

(30) Foreign Application Priority Data

Jul. 19, 2001 (JP) ..... P2001-220557

(51) Int. Cl.[7] ..... H01R 11/22; H01R 13/11
(52) U.S. Cl. ..... 439/849; 439/884
(58) Field of Search ..... 439/849, 850, 439/866, 884

(56) References Cited

U.S. PATENT DOCUMENTS 3,969,012 A * 7/1976 Bauer ..... 439/891
5,445,541 A * 8/1995 May et al. ..... 439/595
5,664,974 A * 9/1997 Endo et al. ..... 439/884
6,287,158 B1 * 9/2001 Brammer ..... 439/874
6,375,521 B2 * 4/2002 Tachi et al. ..... 439/884
6,402,575 B1 * 6/2002 Suzuki ..... 439/884
2002/0111082 A1 * 8/2002 Murakami et al. ..... 439/884
2003/0017757 A1 * 1/2003 Murakami et al. ..... 439/884

* cited by examiner

*Primary Examiner*—Lynn Feild
*Assistant Examiner*—Hae Moon Hyeon
(74) *Attorney, Agent, or Firm*—Finnegan, Henderson, Farabow, Garrett, & Dunner, L.L.P.

(57) ABSTRACT

A connector terminal which includes a terminal base portion; and a tab extending from the terminal base portion to be inserted into an opponent terminal. The tab includes a bottom face portion and an upper face portion which extends from the bottom face portion and is formed by bending so as to overlap the bottom face portion. The bottom face portion and the upper face portion collectively form a tapered portion tapering off to a point at a tip end of the tab. The bottom face portion and the upper face portion are bent so that tip ends thereof approach to each other, and define an inner space therebetween.

8 Claims, 3 Drawing Sheets

CONNECTOR TERMINAL HAVING TAB WITH TAPERED PORTION

BACKGROUND OF THE INVENTION

1. Field of the Invention

The present invention relates to a connector terminal having a tab to be inserted into an opponent terminal.

2. Description of the Related Art

A conceivable connector terminal formed by bending a metal plate of a predetermined shape includes a terminal base portion and a tab extending from the terminal base portion.

The tab is composed of a bottom face portion and an upper face portion formed by bending a portion extending out of the bottom face portion. The upper face portion substantially contacts to the bottom face portion. A tip end side of the tab is pressed to form a tapered portion tapering off to a point.

The bottom face portion and the upper face portion, which collectively constitute the tapered portion of the tab, are squashed in the course of the press. Sharp corners are formed on outer faces of the bottom face portion and the upper face portion. Moreover, excessive mass on tip ends thereof flows out to outer space to generate burrs.

These corners and burrs are caught upon insertion into an opponent terminal, inhibiting smooth insertion.

SUMMARY OF THE INVENTION

The object of the present invention is to provide a connector terminal achieving smooth insertion into an opponent terminal without catches.

An aspect of the present invention is a connector terminal comprising: a terminal base portion; and a tab extending from the terminal base portion to be inserted into an opponent terminal, the tab including: a bottom face portion; and an upper face portion extending from the bottom face portion, formed by bending so as to overlap the bottom face portion, the bottom face portion and the upper face portion collectively forming a tapered portion tapering off to a point at a tip end of the tab, wherein the bottom face portion and the upper face portion are bent so that tip ends thereof approach to each other, and define an inner space therebetween.

According to the aspect constituted as described above, when the bottom face portion and the upper face portion are bent to form the tapered portion by pressing tip ends thereof in directions for them to approach to each other, smoothly curved corners are formed at bending points on outer faces of the bottom face portion and the upper face portion. Moreover, excessive mass of the pressed tip ends, which usually flows out to outer space to generate burrs, will flow into a concave generated at a front end of the tapered portion by bending the bottom face portion and the upper face portion or into the inner space defined therebetween, as allowances for the mass flow. Therefore, the burrs are not generated in positions with which the opponent terminal contacts upon insertion, thus making the insertion of the tab smooth.

BRIEF DESCRIPTION OF THE DRAWINGS

The invention will now be described with reference to the accompanying drawings, wherein.

DETAILED DESCRIPTION OF THE PREFERRED EMBODIMENTS

Figure 1A:
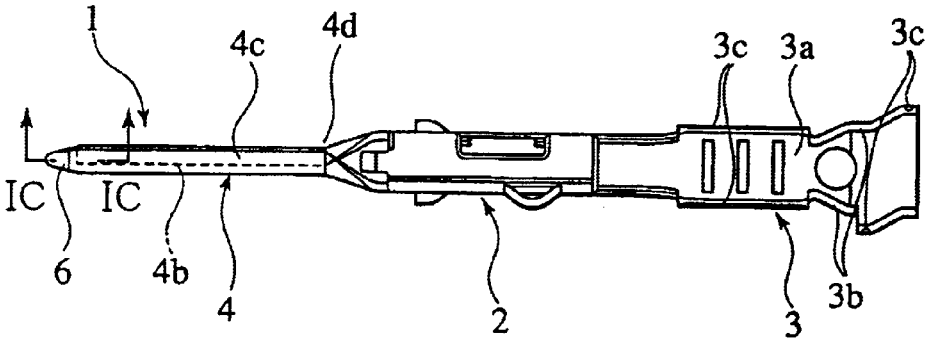
FIG. 1A is a plan view of a connector terminal according to a first embodiment of the present invention.

Embodiments of the present invention will be explained below with reference to the drawings, wherein like members are designated by like reference characters.

[First Embodiment]

Figure 1B:
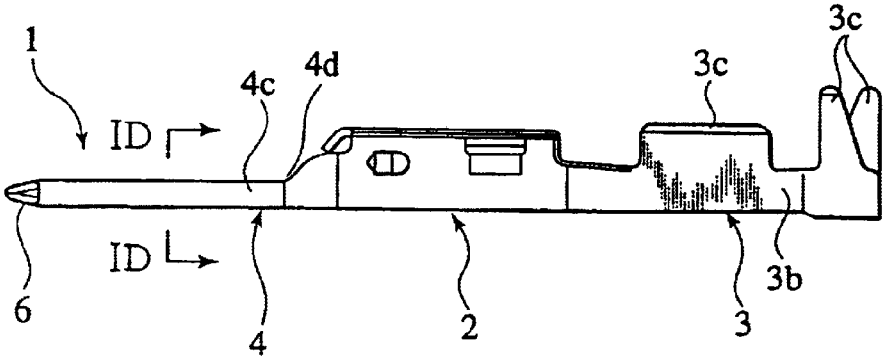
FIG. 1B is a front view of the connector terminal shown in FIG. 1A.

As shown in FIGS. 1A and 1B, a connector terminal 1 is formed by bending a metal plate of a predetermined shape. The connector terminal 1 is composed of a terminal base portion 2, an electric wire fixing portion 3 extending on a back end of the terminal base portion 2, and a tab 4 extending on a tip end of the terminal base portion 2 for contacting with an opponent terminal. The electric wire fixing portion 3 includes a bottom face portion 3*a*, a pair of side plate portions 3*b* standing on the right and left sides of the bottom face portion 3*a*, and electric wire caulking portions 3*c* extending above the respective side plate portions 3*b*. Moreover, an end of an electric wire (not shown) is inserted into a space defined by the bottom face portion 3*a* and the pair of side plate portions 3*b*, and the electric wire is fastened by bending the electric wire caulking portions 3*c* so as to overlap the inserted electric wire.

The tab 4 is composed of a bottom face portion 4*a*, an intermediate plate portion 4*b* formed by bending a portion extending from one of right and left sides of the bottom face portion 4*a*, and an upper face portion 4*c* formed by bending another portion extending from the other one of the right and left sides of the bottom face portion 4*a*. The intermediate plate portion 4*b* is provided almost all over from a foot portion 4*d* to a portion slightly shorter than a tip end portion of the tab 4, and is bent in a manner that a lower plane thereof substantially contacts with the bottom face portion 4*a*. A tip end position of the intermediate plate portion 4*b* is set back from internal bending points 5 of the bottom face portion 4*a* and the upper face portion 4*c* to be bent upon formation of the after-mentioned tapered portion 6 toward the foot portion 4*d* of the tab 4 by a distance D1 (see FIG. 1C). The upper face portion 4*c* is provided all over from the foot portion 4*d* to the tip end portion and bent such that a lower plane thereof substantially contacts with the intermediate plate portion 4*b*. In other words, the upper face portion 4*c* and the intermediate plate portion 4*b* are bent in an overlapping manner. Accordingly, as shown in FIG. 1D, the bottom face portion 4*a*, the intermediate plate portion 4*b* and the upper face portion 4*c* collectively constitute a threefold overlapping structure in a region all over from the foot portion 4*d* to the portion slightly shorter than the tip end portion. Moreover, since the intermediate plate portion 4*b* is not interposed at the tip end portion of the tab 4 between the upper face portion 4*c* and the bottom face portion 4*a*, tip end portions of the upper face portion 4*c* and the bottom face portion 4*a* collectively define an inner space S having a distance D2, which is almost as thick as the intermediate plate portion 4*b*.

Moreover, tip end portions of the bottom face portion 4*a* and the upper face portion 4*c* are formed into the tapered portion 6 by bending, which tapers of f to a point. In other words, if pressure is applied in directions to allow the tip end portions of the bottom face portion 4*a* and the upper face portion 4*c* disposed opposite in parallel, as illustrated with imaginary lines in FIG. 1C, to approach to each other, displacement toward the inner space S defined between the bottom face portion 4*a* and the upper face portion 4*c* is allowed. Accordingly, the bottom face portion 4*a* and the upper face portion 4*c* are bent and formed collectively into a tapered shape as illustrated with solid lines in FIG. 1C.

Figure 1C:
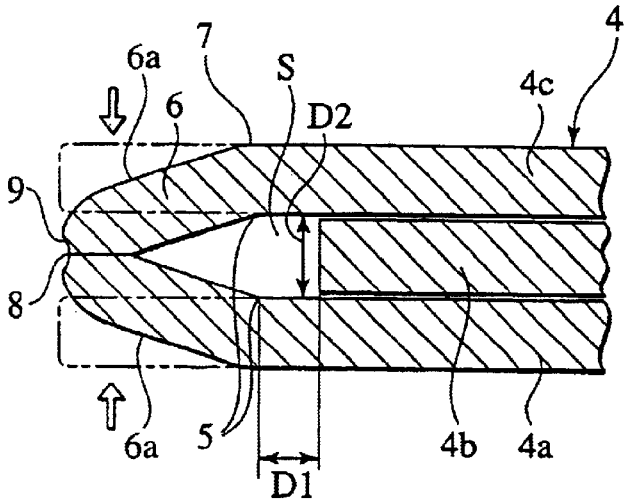
FIG. 1C is an enlarged cross-sectional view of the connector terminal shown in FIG. 1A, which is taken along the IC—IC line in FIG. 1A.
Figure 1D:
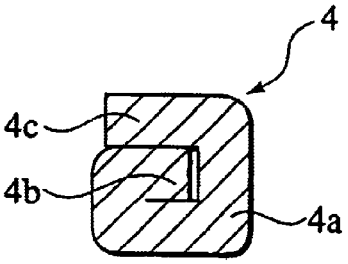
FIG. 1D is an enlarged cross-sectional view of the connector terminal shown in FIG. 1A, which is taken along the ID—ID line in FIG. 1B.

According to the connecter terminal 1, if pressure is applied so as to bend the tip end portions of the bottom face portion 4*a* and the upper face portion 4*c* in the directions for allowing the both portions to approach to each other, then smoothly curved corners are formed at bending points 7 (as shown in FIG. 1C) of tapered faces 6*a* on outer faces of the bottom face portion 4*a* and the upper face portion 4*c*. Moreover, excessive mass of the tip end portions of the inner faces of the bottom face portion 4*a* and the upper face portion 4*c* abutting on each other may flow out of a front end of the mutually abutting position to generate burrs 8. However, in the position where the burrs 8 may be generated, a concave 9 (as shown in FIG. 1C) is generated as allowance for mass flow by bending the bottom face portion 4*a* and the upper face portion 4*c* toward the directions for allowing the both portions to approach to each other, and the excessive mass will flow into the concave 9. The excessive mass can also flow into the inner space S defined as allowance for mass flow between the bottom face portion 4*a* and the upper face portion 4*c*. Therefore, sharp corners are not formed on outer faces of the tab 4, and the burrs are not generated in positions with which the opponent terminal contact upon insertion. Accordingly, the tab 4 can be inserted smoothly into the opponent terminal without being caught.

Moreover, according to the above-described first embodiment, the tab 4 includes the intermediate plate portion 4*b* intervening between the bottom face portion 4*a* and the upper face portion 4*c*, and the tip end position of the intermediate plate portion 4*b* is set back from the internal bending points 5 of the bottom face portion 4*a* and the upper face portion 4*b* to be bent upon formation of the tapered portion 6 toward the foot portion 4*d* of the tab 4. Accordingly, the intermediate plate portion 4*b* does not interfere in the process of bending the tip end portions of the bottom face portion 4*a* and the upper face portion 4*c*. In this way, it is possible to form the tapered portion 6 reliably.

[Second Embodiment]

Figure 2:
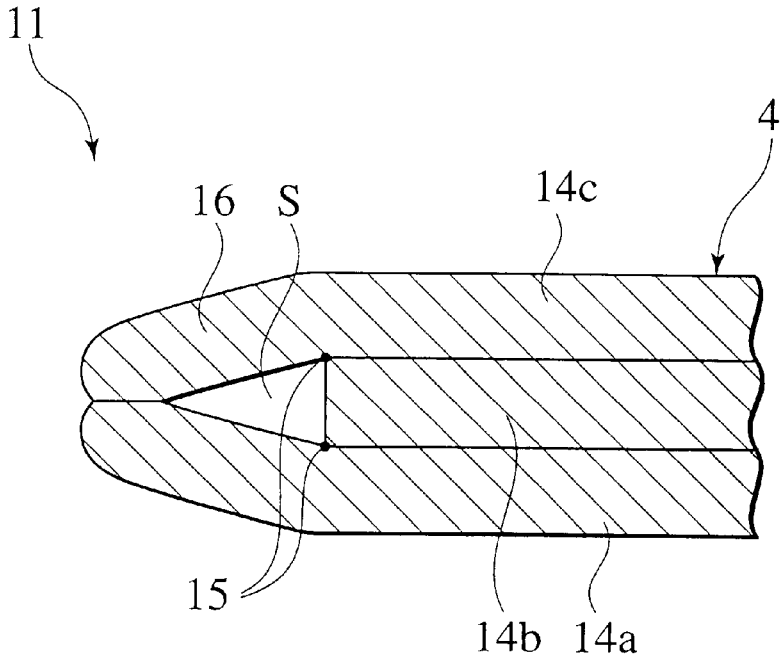
FIG. 2 is a cross-sectional view of principal parts of a tab of a connector terminal according to a second embodiment of the present invention.

As shown in FIG. 2, in the comparison of a connector terminal 11 of the second embodiment with the connecter terminal 1 of the first embodiment, the only difference therein is that a tip end position of an intermediate plate portion 14*b* is located at internal bending points 15 of a bottom face portion 14*a* and an upper face portion 14*c* to be bent upon formation of a tapered portion 16. Since other parts of the constitution of the connector terminal 11 are the same as those in the first embodiment, illustration thereof is omitted. The connector terminal 11 has functions and effects similar to those in the first embodiment.

Moreover, according to the second embodiment, the tip end position of the intermediate plate portion 14*b* is located at the internal bending points 15 of the bottom face portion 14*a* and the upper face portion 14*b* to be bent upon formation of the tapered portion 16. Since the intermediate plate portion 14*b* reaches the internal bending points 15, flatness and strength of the tab 14 can be enhanced.

According to the connector terminal 1 or 11 of the first or the second embodiments, the foot portion 4*d* of the tab 4 or 14 is formed as the threefold structure composed of the bottom face portion 4*a* or 14*a*, the intermediate plate portion 4*b* or 14*b*, and the upper face portion 4*c* or 14*c*. Accordingly, geometrical moment of inertia and a section modulus at the foot portion of the tab 4 or 14 are increased, whereby strength and rigidity at the foot portion 4*d* of the tab 4 or 14 are enhanced.

Moreover, according to the first or the second embodiments, the intermediate plate portion 4*b* or 14*b*, and the upper face portion 4*c* or 14*c* are bent almost in the same condition throughout the tab 4 or 14 from the foot portion to the tip end portion thereof. Accordingly, geometrical moment of inertia and a section modulus at a portion other than the foot portion 4*d* of the tab 4 or 14 are also increased, whereby strength and rigidity at the portion other than the foot portion 4*d* of the tab 4 or 14 are also enhanced. As a result, strength and rigidity of the tab 4 or 14 are enhanced as a whole.

[Third Embodiment]

Figure 3A:
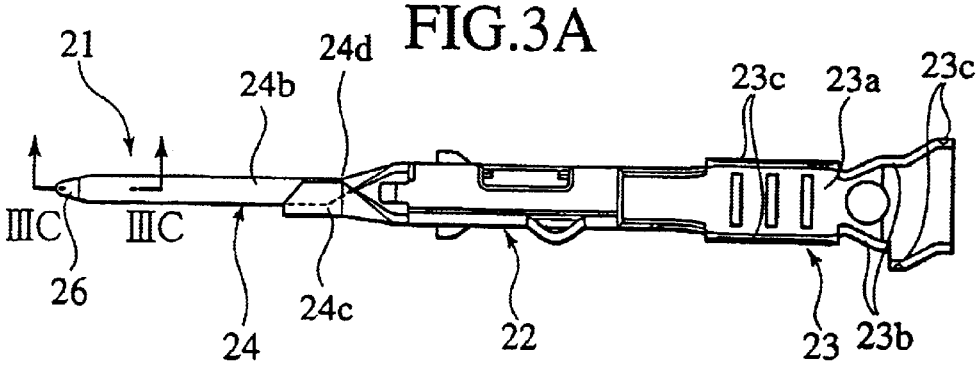
FIG. 3A is a plan view of a connector terminal according to a third embodiment of the present invention.
Figure 3B:
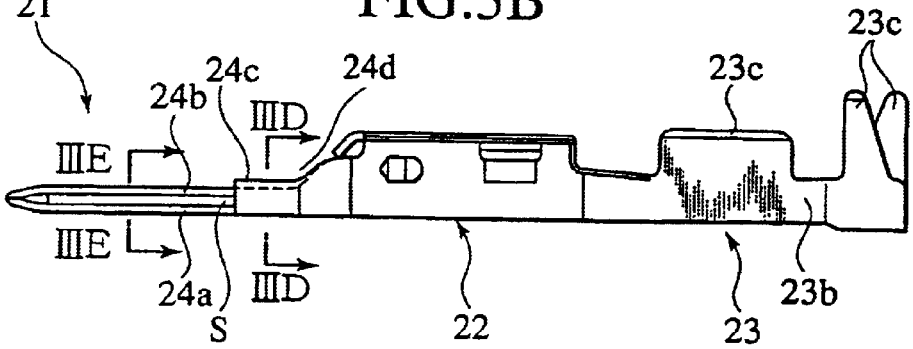
FIG. 3B is a front view of the connector terminal shown in FIG. 3A.
Figure 3C:
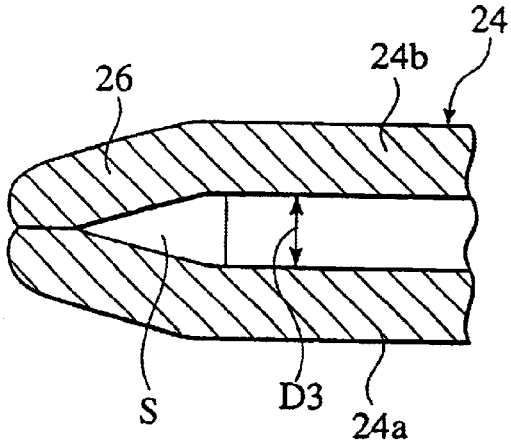
FIG. 3C is an enlarged cross-sectional view of the connector terminal shown in FIG. 3A, which is taken along the IIIC—IIIC line in FIG. 3A.

As shown in FIGS. 3A and 3B, a connector terminal 21 is formed by bending a metal plate of a predetermined shape. The connector terminal 21 is composed of a terminal base portion 22, an electric wire fixing portion 23 extending on a back end of the terminal base portion 22, and a tab 24 extending on a tip end of the terminal base portion 22 for contacting with an opponent terminal. The electric wire fixing portion 23 includes a bottom face portion 23*a*, a pair of side plate portions 23*b* standing on the right and left sides of the bottom face portion 23*a*, and electric wire caulking portions 23*c* extending above the respective side plate portions 23*b*. Moreover, an end of an electric wire (not shown) is inserted into a space defined by the bottom face portion 23*a* and the pair of side plate portions 23*b*, and the electric wire is fastened by bending the electric wire caulking portions 23*c* so as to overlap the inserted electric wire.

Figure 3D:
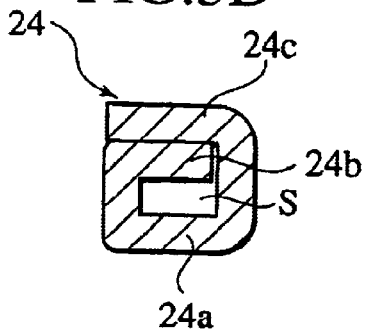
FIG. 3D is an enlarged cross-sectional view of the connector terminal shown in FIG. 3A, which is taken along the IIID—IIID line in FIG. 3B.
Figure 3E:
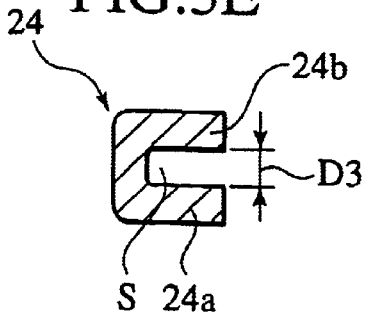
FIG. 3E is an enlarged cross-sectional view of the connector terminal shown in FIG. 3A, which is taken along the IIIE—IIIE line in FIG. 3B.

The tab 24 includes a bottom face portion 24*a*, an upper face portion 24*b* formed by bending a portion extending from one of right and left sides of the bottom face portion 24*a*, and a folded portion 24*c* formed by bending another portion extending from the other one of the right and left sides thereof. The upper face portion 24*b* is provided all over from a foot portion 24*d* to a tip end portion and bent such that a lower plane thereof overlaps the bottom face portion 24*a* with provision of an inner space S having a distance D3 against the bottom face portion 24*a* as shown in FIG. 3E. The folded portion 24*c* is provided only on the foot portion 24*d* and bent such that a lower plane thereof substantially contacts with the upper face portion 24*b* as shown in FIG. 3D. In other words, the folded portion 24*c* and the upper face portion 24*b* are disposed with provision of the inner space S against the bottom face portion 24*a* and bent in an overlapping manner. Accordingly, the foot portion of the tab 24 is formed as threefold consisting of the bottom face portion 24*a*, the upper face portion 24*b* and the folded portion 24*c*, and the portion other than the foot portion of the tab 24 is formed as twofold consisting of the bottom face portion 24*a* and the upper face portion 24*b*, respectively.

According to the connector terminal 21, the tab 24 can be inserted into an opponent terminal smoothly without being caught by the opponent terminal, as similar to the first embodiment.

Moreover, according to the above-described third embodiment, the tab 24 has a simplified constitution with the inner space S defined between the bottom face portion 24*a* and the upper face portion 24*b* in almost an entire area from the tip end to the foot portion 24*d* of the tab 24, contributing to simplification of formation of the tab 24.

According to the connector terminal 21 of the third embodiment, the foot portion 24*d* of the tab 24 is formed as threefold consisting of the bottom face portion 24*a*, the upper face portion 24*b* and the folded portion 24*c*. Accordingly, geometrical moment of inertia and a section modulus at the foot portion 24*d* of the tab 24 are increased, whereby strength and rigidity at the foot portion 24*d* of the tab 24 are further enhanced.

Moreover, according to the third embodiment, the upper face portion 24*b* and the folded portion 24*c* of the foot portion 24*d* of the tab 24 are bent so as to overlap each other with provision of the inner space S against the bottom face portion 24*a*. Therefore, the foot portion 24*d* of the tab 24 shows geometrical moment of inertia and a section modulus which are higher than those in the case of overlapping the bottom face portion 24*a*, the upper face portion 24*b* and the folded portion 24*c* in a substantially contacting manner (the first and the second embodiments). Hence, strength and rigidity of the foot portion 24*d* of the tab 24 are further enhanced.

Furthermore, according to the third embodiment, the upper face portion 24*b* at a portion other than the foot portion 24*d* of the tab 24 is bent so as to overlap each other with provision of the inner space S against the bottom face portion 24*a*. Therefore, the portion other than the foot portion 24*d* of the tab 24 shows geometrical moment of inertia and a section modulus which are higher than those in the case of overlapping the bottom face portion 24*a* and the upper face portion 24*b* in the substantially contacting manner (the first and the second embodiments). Hence, strength and rigidity of the portion other than the foot portion 24*d* of the tab 24 are also enhanced. As a result, strength and rigidity of the tab 24 are enhanced as a whole.

Although only three embodiments of the invention have been disclosed and described, it is apparent that the other embodiments and modification of the invention are possible.

What is claimed is:

1. A connector terminal comprising:

a terminal base portion; and a tab extending from the terminal base portion to be inserted into an opponent terminal, the tab including:

a bottom face portion;

an upper face portion extending from the bottom face portion, formed by bending so as to overlap the bottom face portion, the bottom face portion and the upper face portion collectively forming a tapered portion tapering off to a point at a tip end of the tab; and an intermediate plate portion formed by a return portion of the bottom face portion bent back over the bottom face portion, wherein the bottom face portion and the upper face portion are bent so that tip ends thereof approach to each other, and define an inner space therebetween.

2. The connector terminal according to claim 1, wherein the intermediate plate portion intervenes between the bottom face portion and the upper face portion, and a tip end of the intermediate plate portion is closer to a foot portion of the tab than internal bending points of the bottom face portion and the upper face portion of the tapered portion.

3. The connector terminal according to claim 1, wherein the intermediate plate portion intervenes between the bottom face portion and the upper face portion, and a tip end of the intermediate plate portion is set in a position identical to internal bending points of the bottom face portion and the upper face portion of the tapered portion.

4. The connector terminal according to claim 1, wherein the tab is configured with the inner space in a region from a tip end to a foot portion thereof.

5. A connector terminal comprising:

a terminal base portion; and a tab extending from the terminal base portion to be inserted into an opponent terminal, the tab including:

a bottom face portion; and an upper face portion extending from the bottom face portion, formed by bending so as to overlap the bottom face portion, the bottom face portion and the upper face portion collectively forming a tapered portion at a tip end of the tab, wherein the bottom face portion and the upper face portion are bent so that tip ends thereof approach to each other, and generate a concave at the tip end of the tab.

6. The connector terminal according to claim 5, wherein the tab includes an intermediate plate portion intervening between the bottom face portion and the upper face portion, and a tip end of the intermediate plate portion is closer to a foot portion of the tab than internal bending points of the bottom face portion and the upper face portion of the tapered portion.

7. The connector terminal according to claim 5, wherein the tab includes an intermediate plate portion intervening between the bottom face portion and the upper face portion, and a tip end of the intermediate plate portion is set in a position identical to internal bending points of the bottom face portion and the upper face portion of the tapered portion.

8. The connector terminal according to claim 5, wherein the tab is configured with an inner space defined between the bottom face portion and the upper face portion in a region from a tip end to a foot portion of the tab.

* * * * *